US010262608B2

(12) United States Patent
Ahn et al.

(10) Patent No.: US 10,262,608 B2
(45) Date of Patent: Apr. 16, 2019

(54) DISPLAY DEVICE AND DRIVING METHOD THEREOF

(71) Applicant: Samsung Display Co., Ltd., Yongin-si (KR)

(72) Inventors: Ik Hyun Ahn, Hwaseong-si (KR); Woo Joo Lee, Seoul (KR); Hyun Sik Hwang, Hwaseong-si (KR); Bong Im Park, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 670 days.

(21) Appl. No.: 14/853,582

(22) Filed: Sep. 14, 2015

(65) Prior Publication Data

US 2016/0196799 A1 Jul. 7, 2016

(30) Foreign Application Priority Data

Jan. 6, 2015 (KR) ..... 10-2015-0001279

(51) Int. Cl.
*G09G 3/36* (2006.01)

(52) U.S. Cl.
CPC ..... *G09G 3/3648* (2013.01); *G09G 2310/067* (2013.01); *G09G 2310/08* (2013.01); *G09G 2320/0223* (2013.01)

(58) Field of Classification Search
CPC ..... G09G 5/12; G09G 5/18; G09G 3/2003; G09G 3/3648
See application file for complete search history.

(56) References Cited

U.S. PATENT DOCUMENTS 6,717,563 B2 * 4/2004 Kim ..... G09G 3/3648 345/94
7,737,935 B2 * 6/2010 Kim ..... G09G 3/3677 345/100
2002/0015017 A1 * 2/2002 Kwag ..... G09G 3/3648 345/89
2003/0038766 A1 * 2/2003 Lee ..... G09G 3/3648 345/87
2006/0290644 A1 * 12/2006 Kim ..... G09G 3/3677 345/100
2011/0148954 A1 * 6/2011 Tobita ..... G09G 3/3688 345/698
2012/0105605 A1 * 5/2012 Nam ..... G09G 3/003 348/51

(Continued)

FOREIGN PATENT DOCUMENTS

KR 1020080001890 1/2008
KR 1020130002702 1/2013

(Continued)

*Primary Examiner* — Alexander Eisen
*Assistant Examiner* — Mansour M Said
(74) *Attorney, Agent, or Firm* — Cantor Colburn LLP

(57) ABSTRACT

A display device includes a display unit including a plurality of pixels, a plurality of gate lines and a plurality of data lines which are connected to the plurality of pixels, a data driver applying data voltages to the plurality of data lines, and a gate driver delaying and outputting first gate signals applied to gate lines among the plurality of gate lines in a first sub-frame included in one frame and advancing and outputting second gate signals which are applied to remaining gate lines among the plurality of gate lines in a second sub-frame.

17 Claims, 6 Drawing Sheets

(56) References Cited

U.S. PATENT DOCUMENTS

| | | | | |
|---|---|---|---|---|
| 2012/0120044 | A1* | 5/2012 | Mizunaga | G09G 3/3614<br>345/211 |
| 2012/0287100 | A1* | 11/2012 | Woo | G09G 3/3651<br>345/209 |
| 2016/0189586 | A1* | 6/2016 | Zou | G09G 3/3266<br>345/213 |

FOREIGN PATENT DOCUMENTS

| | | |
|---|---|---|
| KR | 1020140051745 | 5/2014 |
| KR | 1020140082413 | 7/2014 |

* cited by examiner

DISPLAY DEVICE AND DRIVING METHOD THEREOF

This application claims priority to Korean Patent Application No. 10-2015-0001279 filed on Jan. 6, 2015, and all the benefits accruing therefrom under 35 U.S.C. § 119, the entire contents of which are incorporated herein by reference.

BACKGROUND (a) Field

Embodiments of the invention relate to a display device and a driving method thereof.

(b) Description of the Related Art

Currently, display devices such as a liquid crystal display, a field emission display, a plasma display panel, and an organic light emitting display have been widely used.

Typically, such display devices include a plurality of gate lines formed in a row direction, a plurality of data lines formed in a column direction, and a plurality of pixels arranged at points where the plurality of gate lines and the plurality of data lines cross each other. The plurality of pixels is driven by gate signals and data voltages transferred by the plurality of gate lines and the plurality of data lines.

SUMMARY

The invention has been made in an effort to provide a display device and a driving method thereof having advantages of compensating for the delay of a gate signal due to wire resistance of a clock signal.

An exemplary embodiment of the invention provides a display device including a display unit including a plurality of pixels, and a plurality of gate lines and a plurality of data lines which are connected to the plurality of pixels, a data driver applying data voltages to the plurality of data lines, and a gate driver delaying and outputting first gate signals applied to gate lines among the plurality of gate lines in a first sub-frame included in one frame and advancing and outputting second gate signals which are applied to remaining gate lines among the plurality of gate lines in a second sub-frame.

In an exemplary embodiment, the gate lines to which the first gate signals are applied may be disposed to be closer to an output terminal of the data driver and the gate lines to which the second gate signals are applied may be disposed to be far from the output terminal of the data driver.

In an exemplary embodiment, the first sub-frame may be a period when the delay of the data voltage is superior to the output delay of the first gate signals in one frame.

In an exemplary embodiment, the second sub-frame may be a period when the output delay of the second gate signals is superior to the delay of the data voltage in one frame.

In an exemplary embodiment, the gate driver may increase a time period for which the gate-on voltage of each of the first gate signals is applied by a reference data delay value, and the reference data delay value may be a value obtained by dividing a data delay value generated in the last gate line among the plurality of gate lines by the number of the plurality of gate lines.

In an exemplary embodiment, the gate driver may decrease a time period for which the gate-on voltage of each of the second gate signals is applied by the reference data delay value, and the reference data delay value may be a value obtained by dividing a data delay value generated in the last gate line among the plurality of gate lines by the number of the plurality of gate lines.

In an exemplary embodiment, in the first sub-frame, a time period of the first sub-frame may be determined so as to adjust an output enable ("OE") margin between the first gate signals and the plurality of data voltages to an optimal OE margin, and the OE margin may be a time between a timing when the gate signal starts to be shifted from the gate-on voltage to the gate-off voltage and a timing when the data voltage at a high level starts to be shifted to a low level.

In an exemplary embodiment, in the second sub-frame, a time period of the second sub-frame may be determined so as to adjust an OE margin between the second gate signals and the plurality of data voltages to an optimal OE margin.

In an exemplary embodiment, the first sub-frame and the second sub-frame may have the same time period as ½ frame.

Another exemplary embodiment of the invention provides a display device including a display unit including a plurality of pixels, and a plurality of gate lines and a plurality of data lines which are connected to the plurality of pixels, a data driver applying data voltages to the plurality of data lines, and a gate driver increasing and decreasing the time period for which the gate-on voltage is applied while alternating the plurality of gate signals applied to the plurality of gate lines for each line.

In an exemplary embodiment, the gate driver may increase a time period for which the gate-on voltages of the gate signals applied to odd gate lines among the plurality of gate lines are applied by a reference data delay value, and the reference data delay value may be a value obtained by dividing a data delay value generated in the last gate line among the plurality of gate lines by the number of the plurality of gate lines.

In an exemplary embodiment, the gate driver may decrease a time period for which the gate-on voltages of the gate signals applied to even gate lines among the plurality of gate lines are applied by the reference data delay value.

Yet another exemplary embodiment of the invention provides a driving method of a display device including a plurality of pixels, and a plurality of gate lines and a plurality of data lines which are connected to the plurality of pixels, the method including delaying and outputting first gate signals applied to gate lines among the plurality of gate lines in a first sub-frame included in one frame, and advancing and outputting second gate signals which are applied remaining gate lines among the plurality of gate lines in a second sub-frame included in one frame.

In an exemplary embodiment, the gate lines to which the first gate signals are applied may be disposed to be closer to an output terminal of the data driver and the gate lines to which the second gate signals are applied may be disposed to be far from the output terminal of the data driver.

In an exemplary embodiment, the driving method may further include calculating a reference data delay value by dividing a data delay value generated in the last gate line among the plurality of gate lines by the number of the plurality of gate lines, in which the first gate signals may be delayed and output by increasing a time period for which the gate-on voltage of each of the first gate signals is applied by the reference data delay value.

In an exemplary embodiment, the second gate signals may be advanced and output by decreasing a time period for which the gate-on voltage of each of the second gate signals is applied by the reference data delay value.

In an exemplary embodiment, the driving method may further include determining a time period of the first sub-frame so that an OE margin which is a time between a timing when the first gate signal starts to be shifted from the gate-on voltage to the gate-off voltage and a timing when the data voltage at a high level starts to be shifted to a low level is adjusted to an optimal OE margin.

In an exemplary embodiment, the driving method may further include determining a time period of the second sub-frame so that an OE margin which is a time between a timing when the second gate signal starts to be shifted from the gate-on voltage to the gate-off voltage and a timing when the data voltage at a high level starts to be shifted to a low level is adjusted to an optimal OE margin.

In an exemplary embodiment, the first sub-frame and the second sub-frame may have the same time period as ½ frame.

In an exemplary embodiment, the first sub-frame may be a period when the delay of the data voltage is superior to the output delay of the first gate signals in one frame, and the second sub-frame may be a period when the output delay of the second gate signals is superior to the delay of the data voltage in one frame.

Gate signals which are sequentially applied to the plurality of gate lines are delayed and applied to gate lines with lower priority by wire resistance of a clock signal applied to a gate driving circuit. Particularly, an output function of the gate signal to a driving integrated circuit ("IC") outputting the data voltage is integrated, and as a result, in a type integrated on the display substrate, the gate signals in the gate lines with lower priority due to the wire resistance of the clock signal are largely delayed. The delay of the gate signal causes deviation of synchronization with data voltage, and as a result, the data voltage is not sufficiently charged. When the data voltage is not sufficiently charged in the pixel, the pixel does not emit light with a desired gray to cause bad image quality.

However, according to the exemplary embodiment of the invention, it is possible to compensate for the delay of the gate signal due to wire resistance of the clock signal and improve image quality so that the data voltage may be sufficiently charged in the pixel.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
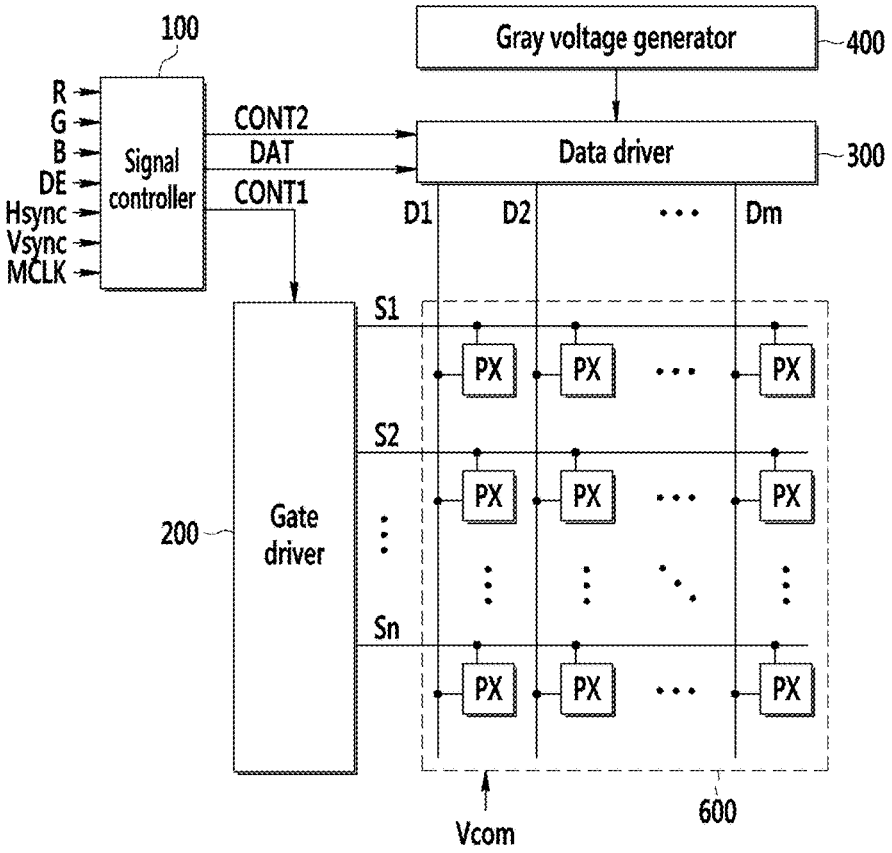
FIG. 1 is a block diagram of an exemplary embodiment of a display device according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

Further, in exemplary embodiments, since like reference numerals designate like elements having the same configuration, a first exemplary embodiment is representatively described, and in other exemplary embodiments, only a configuration different from the first exemplary embodiment will be described.

Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, a display device according to an exemplary embodiment of the invention will be described in detail with reference to the accompanying drawings. The display device according to the exemplary embodiment of the invention may be any one of a LCD, a field emission display, a plasma display panel, and an organic light emitting display. Hereinafter, for convenience of description, the LCD will be described as an example.

FIG. 1 is a block diagram of a display device according to an exemplary embodiment of the invention.

Referring to FIG. 1, the display device includes a signal controller 100, a gate driver 200, a data driver 300, a gray voltage generator 400, and a display unit 600.

The display unit 600 includes a plurality of gate lines S1-Sn, a plurality of data lines D1-Dm, and a plurality of pixels PX. The plurality of pixels PX is connected to the plurality of gate lines S1-Sn and the plurality of data lines D1-Dm to be arranged substantially in a matrix form. The plurality of gate lines S1-Sn is extended substantially in a row direction to be substantially parallel to each other. The plurality of data lines D1-Dm is extended substantially in a column direction to be substantially parallel to each other. On a rear surface of the display unit 600, a backlight (not illustrated) controlling brightness of an image which is displayed on the display unit 600 may be provided. The backlight emits light to the display unit 600. A common voltage Vcom for driving the pixel PX may be applied to the display unit 600.

The signal controller 100 receives image signals R, G, and B and an input control signal. The image signals R, G, and B store brightness information of the plurality of pixels. In an exemplary embodiment, the brightness may have a predetermined number, for example, 1024 (i.e., $2^{10}$), 256 (i.e., $2^8$) or 64 (i.e., $2^6$) of grays. The input control signal includes a data enable signal DE, a horizontal synchronization signal Hsync, a vertical synchronization signal Vsync, and a main clock signal MCLK.

The signal controller 100 generates a gate control signal CONT1, a data control signal CONT2, and an image data signal DAT according to the image signal R, G, and B, the data enable signal DE, the horizontal synchronization signal Hsync, the vertical synchronization signal Vsync, and the main clock signal MCLK. The signal controller 100 may generate an image data signal DAT by dividing the image signals R, G, and B by a unit of a frame according to the vertical synchronization signal Vsync and dividing the image signals R, G, and B by a unit of a gate line according to the horizontal synchronization signal Hsync.

The signal controller 100 provides the image data signal DAT and the data control signal CONT2 to the data driver 300. The data control signal CONT2 as a signal controlling an operation of the data driver 300 includes a horizontal synchronization start signal notifying the transmission start of the image data signal DAT, a load signal instructing the output of the data signal to the data lines D1-Dm, and a data clock signal. The data control signal CONT2 may further include a reverse signal for inverting a voltage polarity of the image data signal DAT for the common voltage Vcom.

The signal controller 100 provides the gate control signal CONT1 to the gate driver 200. The gate control signal CONT1 includes at least one clock signal controlling the output of the scanning start signal and the gate-on voltage from the gate driver 200. In an exemplary embodiment, the gate control signal CONT1 may further include an output enable signal limiting the duration of the gate-on voltage.

The gate driver 200 is connected to the plurality of gate lines S1-Sn and applies a gate signal, which is configured in combination of a gate-on voltage and a gate-off voltage which respectively turn on and off a switching element Q (see FIG. 2) connected to the plurality of gate lines S1-Sn and the plurality of data lines D1-Dm.

The data driver 300 is connected to the plurality of data lines D1-Dm and selects a gray voltage from the gray voltage generator 400. The data driver 300 applies the selected gray voltage to the data lines D1-Dm as the data voltage. In an exemplary embodiment, the gray voltage generator 400 may provide only a predetermined number of reference gray voltages without providing voltages for all grays. In this case, the data driver 300 may divide the reference gray voltage to generate gray voltages for all of the grays and select the data voltages among the generated gray voltages.

A difference between the data voltage applied to the pixel PX and the common voltage Vcom is represented as a charging voltage of a liquid crystal capacitor Clc (see FIG. 2), that is, a pixel voltage. The alignment of the liquid crystal molecules varies according to a magnitude of the pixel voltage, and as a result, the polarization of light passing through the liquid crystal layer 3 is changed. The change in the polarization is represented as a change in transmittance of the light by a polarizer, and as a result, the pixel PX displays brightness expressed by grays of the image signals R, G, and B.

The gate signals of the gate-on voltages are sequentially applied to the plurality of gate lines S1-Sn by setting one horizontal period as a unit period, and the data voltages are applied to the plurality of data lines D1-Dm corresponding to the gate signals of the gate-on voltages. As a result, the data voltages are applied to all the pixels PX to display images in one frame. The one horizontal period is referred to as '1H' and the same as one period of the horizontal synchronization signal Hsync and the data enable signal DE.

When one frame ends, the next frame starts and a state of the reverse signal applied to the data driver 300 is controlled so that the polarity of the data voltage applied to each pixel PX is opposite to the polarity in the previous frame ("frame inversion"). In this case, even in one frame, according to a characteristic of the inversion signal, a polarity of the data voltage applied to one data line is periodically changed (row inversion and dot inversion), or polarities of data voltages applied to one pixel row may be different from each other (column inversion and dot inversion). The data voltage may be divided into a positive data voltage and a negative data voltage according to a polarity. The positive data voltage for a gray is higher than the negative data voltage for the same gray.

In an exemplary embodiment, each of the signal controller 100, the gate driver 200, the data driver 300, and the gray voltage generator 400 described above may be directly mounted on the display unit 600 in at least one integrated circuit ("IC") chip form, mounted on a flexible printed circuit film (not illustrated), attached to the display unit 600 in a tape carrier package ("TCP") form, or mounted on a separate printed circuit board ("PCB", not illustrated). In an alternative exemplary embodiment, the signal controller 100, the gate driver 200, the data driver 300, and the gray voltage generator 400 may be integrated on the display unit 600 together with the signal lines S1-Sn and D1-Dm.

Figure 2:
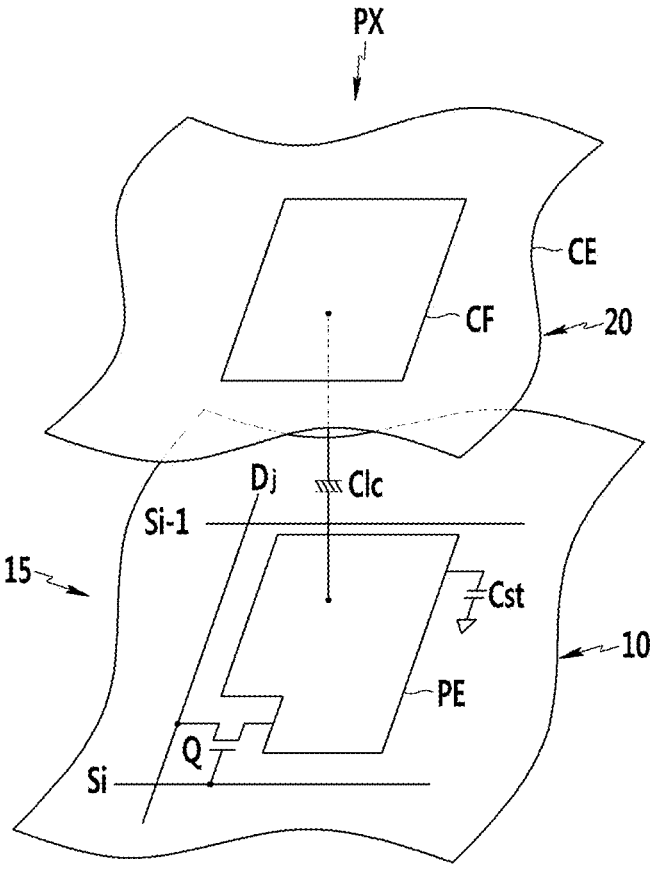
FIG. 2 is a circuit diagram illustrating the exemplary embodiment of an equivalent circuit of one pixel in the display device according to the invention.

FIG. 2 is a circuit diagram illustrating an equivalent circuit of one pixel in the display device according to the exemplary embodiment of the invention.

Referring to FIG. 2, one pixel PX included in the display unit 600 will be described. A pixel PX connected to an i-th gate line Si and a j-th data line Dj ($1<i<n$, $1<j<m$) will be described as an exemplary embodiment. The pixel PX includes a switching element Q, and a liquid crystal capacitor Clc and a storage capacitor Cst which are connected to the switching element Q.

The switching element Q is a three-terminal element such as a thin film transistor ("TFT") provided on a lower panel 10. The switching element Q includes a gate terminal connected to the gate lines S1-Sn, an input terminal connected to the data lines D1-Dm, and an output terminal connected to the liquid crystal capacitor Clc and the storage capacitor Cst. In an exemplary embodiment, the TFT includes amorphous silicon or polycrystalline silicon, for example.

In an exemplary embodiment, the TFT may be an oxide TFT in which a semiconductor layer is configured by an oxide semiconductor, for example.

In an exemplary embodiment, the oxide semiconductor material may include at least one of oxides based on titanium (Ti), hafnium (Hf), zirconium (Zr), aluminum (Al), tantalum (Ta), germanium (Ge), zinc (Zn), gallium (Ga), tin (Sn), or indium (In), and zinc oxide (ZnO), indium-gallium-zinc oxide (InGaZnO4), indium-zinc oxide (Zn—In—O), zinc tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O) which are complex oxide thereof, for example.

The semiconductor layer includes a channel region in which impurities are not doped, and a source region and a drain region disposed at two sides of the channel region, in which impurities are doped. Herein, the impurities vary according to a kind of TFT, and may be N-type impurities or P-type impurities.

In the case where the semiconductor layer includes the oxide semiconductor, in order to protect the oxide semiconductor vulnerable to an external environment such as exposure at a high temperature, for example, a separate passivation layer may be added.

The liquid crystal capacitor Clc uses a pixel electrode PE and a common electrode CE of the lower panel 10 as two terminals, and a liquid crystal layer 15 between the pixel electrode PE and the common electrode CE functions as a dielectric material. The liquid crystal layer 15 has dielectric anisotropy. A pixel voltage is defined by a voltage difference between the pixel electrode PE and the common electrode CE.

The pixel electrode PE is connected to the switching element Q. The common electrode CE receives a common voltage Vcom. In an exemplary embodiment, the common electrode CE may be disposed on the entire surface of the upper panel 20. Unlike those illustrated in FIG. 2, in another exemplary embodiment, the common electrode CE may be disposed on the lower panel 10, and in this case, at least one of the pixel electrode PE and the common electrode CE may be provided in a linear shape or a rod shape.

The storage capacitor Cst which plays a subordinate role of the liquid crystal capacitor Clc is provided by overlapping a separate signal line (not illustrated) included in the lower panel 10 and the pixel electrode PE with an insulator therebetween, and a predetermined voltage such as a common voltage Vcom may be applied to the separate signal line.

A color filter CF may be disposed on the upper panel 20. In an alternative exemplary embodiment, the color filter CF may also be disposed on or below the pixel electrode PE of the lower panel 10. Each pixel PX uniquely displays one of the primary colors and enables a desired color to be recognized by a spatial sum of the primary colors. Each pixel PX alternately displays the primary colors with time and enables a desired color to be recognized by a temporal sum of the primary colors. In an exemplary embodiment, the basic color may include the three primary colors of red, green, and blue, for example.

Hereinafter, when the gate signals are sequentially applied to the plurality of gate lines S1-Sn, an exemplary embodiment in which the gate signals are delayed toward the gate lines with lower priority will be described with reference to FIGS. 3 and 4.

Figure 3:
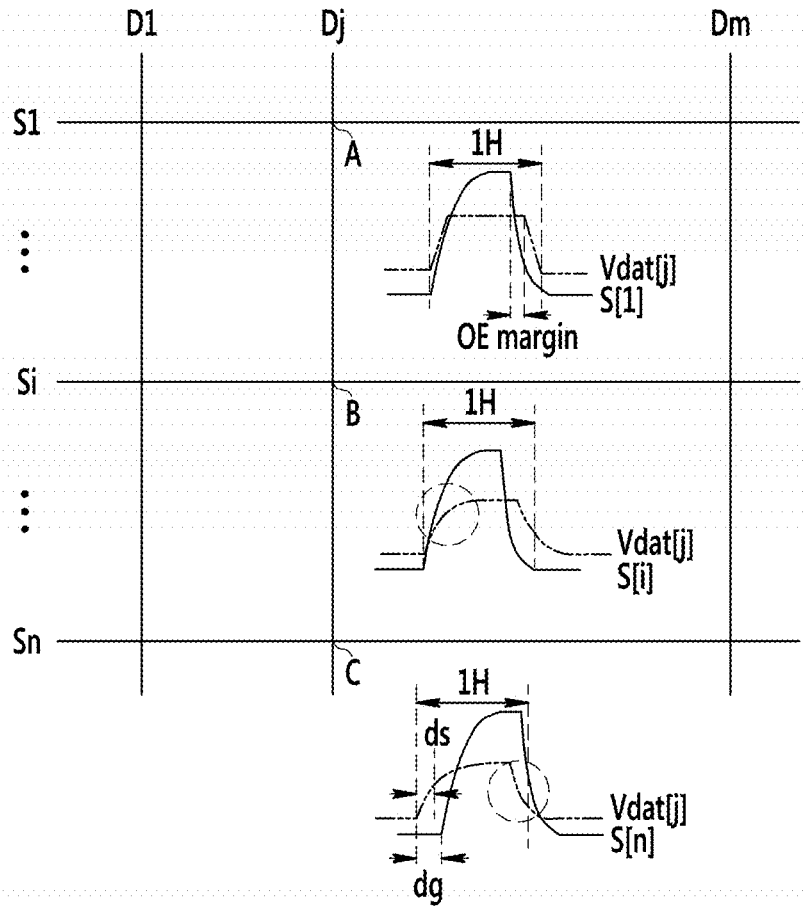
FIG. 3 is an exemplary diagram illustrating one example in which gate signals are delayed toward gate lines with lower priority.

FIG. 3 is an exemplary diagram illustrating one example in which gate signals are delayed toward gate lines with lower priority, i.e., gate lines which are farther from the data driver 300. In the structure in which the signal controller 100, the gate driver 200, the data driver 300, and the gray voltage generator 400 are integrated on the lower panel 10, that is, the display unit 600, together with the signal lines S1-Sn and D1-Dm, the gate signals and the data voltages are measured.

Referring to FIG. 3, at a point A where a intermediate data line Dj among the plurality of data lines D1-Dm and a first gate line S1 among the plurality of gate lines S1-Sn which is closest to an output terminal of the data driver 300 cross each other, a gate signal S[1] and a data voltage Vdat[j] are measured. The intermediate data line Dj is j-th farthest from the output terminal of the gate driver 200. In addition, at a point B where the intermediate data line Dj and a intermediate gate line Si among the plurality of gate lines S1-Sn, a gate signal S[i] and the data voltage Vdat[j] are measured. In addition, at a point C where the intermediate data line Dj and the last gate line Sn among the plurality of gate lines S1-Sn, a gate signal S[n] and the data voltage Vdat[j] are measured.

Until the data voltage Vdat[j] applied to the data line Dj reaches the point A, the delay hardly occurs, but is changed by the wire resistance of the data line Dj toward the point C. As a result, while the magnitude of the data voltage Vdat[j] is decreased, the data voltage Vdat[j] is delayed. At the point C, a delay of the data voltage Vdat[j] is increased by a value ds due to the wire resistance of the data line Dj where the value ds is referred to as a data delay value.

At the points A, B, and C, the gate signals S[1], S[i], and S[n] are not instantaneously increased to a gate-on voltage (a high level voltage) but reach the gate-on voltage after a predetermined time, and when the gate signals S[1], S[i], and S[n] are decreased from the gate-on voltage to a gate-off voltage (a low level voltage), the gate signals S[1], S[i], and S[n] reach the gate-off voltage after a predetermined time.

In the structure in which the signal controller 100, the gate driver 200, the data driver 300, and the gray voltage generator 400 are integrated on the lower panel 10 together with the signal lines S1-Sn and D1-Dm, the clock signal for generating the gate signal is generated at the data driver 300 to be transferred from the circuit of the first gate line S1 to the circuit of the last gate line Sn along a clock signal wire (not illustrated). Such a clock signal may be delayed toward the last gate line Sn by the resistance of the clock signal wire to be transferred. As a result, the gate signals S[1], S[i], and S[n] are delayed and output toward the last gate line Sn from the first gate line S1. At the point C, the gate signal S[n] is delayed and output by a value dg where the value dg is referred to as a gate delay value.

At the point A, it can be seen that the data voltage Vdat[1] and the gate signal S[1] are hardly delayed. A time period for which the gate signal S[1] applied to the first gate line S1 is the gate-on voltage and a time period for which the data voltage Vdat[j] is increased substantially overlap with each other. As a result, the data voltage Vdat[j] may be sufficiently charged in a pixel at the point A.

At the point B, it can be seen that the degree that the data voltage Vdat[j] is delayed is larger than the degree that the gate signal S[i] is delayed and output. Like a portion represented by a circle, a charging loss of the data voltage Vdat[j] occurs by the delay of the data voltage Vdat[j]. That is, there is a problem in that the data voltage Vdat[j] is not sufficiently charged in a pixel at the point B.

At the point C, it can be seen that the degree that the gate signal S[n] is delayed and output is larger than the degree that the data voltage Vdat[j] is delayed. Like a portion represented by a circle, the charging loss of the data voltage Vdat[j] occurs by the delay output of the gate signal S[n]. That is, there is a problem in that the data voltage Vdat[j] is not sufficiently charged in a pixel at the point C.

At the point A, the gate signal S[1] and the data voltage Vdat[j] have an output enable ("OE") margin. The OE margin means a time between a timing when the gate signal S[1] starts to be shifted from the gate-on voltage to the gate-off voltage and a timing when the data voltage Vdat[j] at a high level starts to be shifted to a low level. When the OE margin has an optimal time, the data voltage Vdat[j] may be maximally charged in the pixel, and the pixel may emit light with maximum brightness in response to the data voltage Vdat[j].

At the point A, when the gate signal S[1] and the data voltage Vdat[j] have an optimal OE margin, at the points B and C, the gate signals S[i] and S[n] and the data voltage Vdat[j] do not have the optimal OE margin by the delay of the data signal Vdat[j] and the delay output of the gate signals S[i] and S[n].

Figure 4:
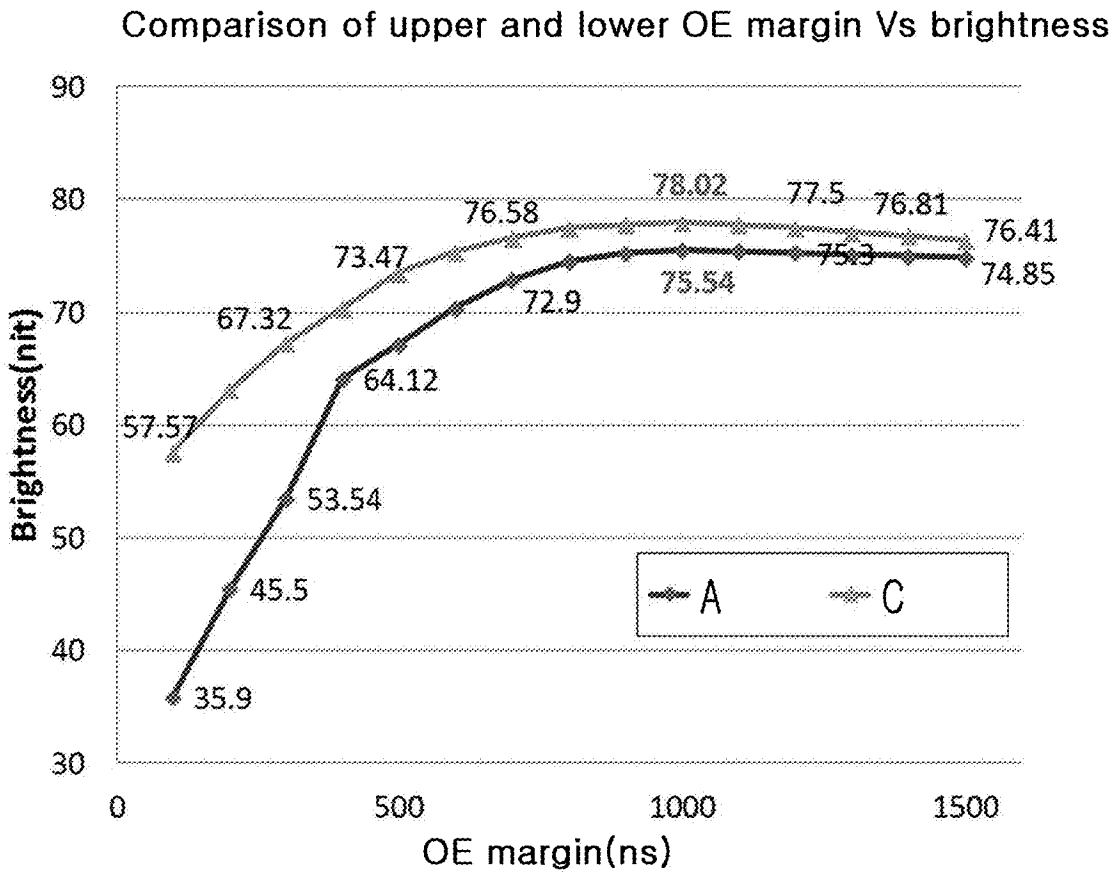
FIG. 4 is a graph measuring a relationship in brightness for an output enable ("OE") margin between a gate signal and a data voltage.

FIG. 4 is a graph measuring a relationship of brightness for the OE margin between the gate signal and the data voltage.

Referring to FIG. 4, with respect to the points A and C of FIG. 3, the brightness for the OE margin is measured. When the OE margin is approximately 1,000 nanoseconds (ns), at the points A and C, maximum brightness is measured. In the exemplary embodiment, the optimal OE margin is approximately 1,000 ns, for example. The brightness is reduced as the OE margin deviates from the optimal OE margin.

Accordingly, when the gate signal synchronizes with the data voltage, the OE margin between the gate signal and the data voltage may be adjusted to the optimal OE margin.

Hereinafter, a method of compensating for the delay of the data signal and the delay output of the gate signal will be described with reference to FIGS. 5 and 6.

Figure 5:
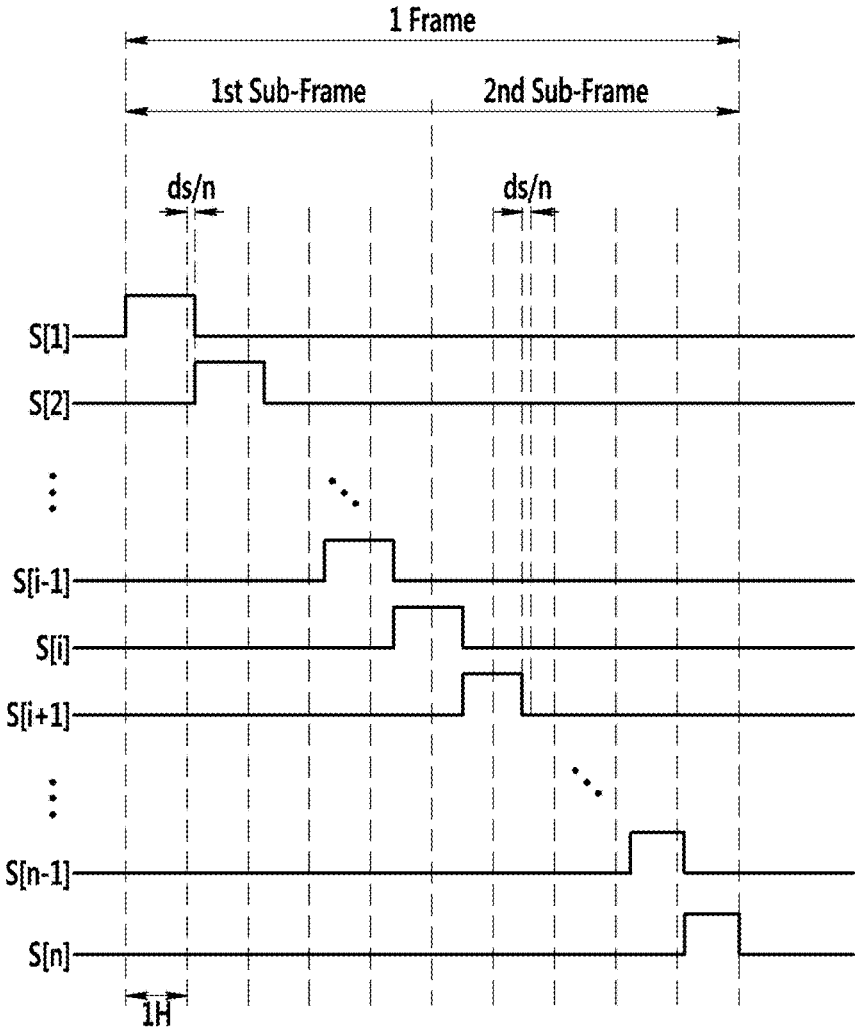
FIG. 5 is a timing diagram illustrating the exemplary embodiment of a method of applying a gate signal in the display device according to the invention.

FIG. 5 is a timing diagram illustrating a method of applying a gate signal in the display device according to the exemplary embodiment of the invention.

Referring to FIG. 5, in the exemplary embodiment of the invention, the gate driver 200 (refer to FIG. 1) delays turn-on periods of gate signals S[1] to S[i] and outputs the gate signals S[1] to S[i] which are applied to gate lines S1 to Si among the plurality of gate lines S1 to Sn in a first sub-frame included in one frame such that turn-on periods of the gate signals S[1] to S[i] increases. In addition, the gate driver 200 advances turn-on periods of gate signals S[i+1] to S[n] and outputs the gate signals S[i+1] to S[n] which are applied to the remaining gate lines S1+1 to Sn among the plurality of gate lines S1 to Sn in a second sub-frame included in one frame such that turn-on periods of the gate signals S[i+1] to S[n] decreases.

In the first sub-frame, the gate lines S1 to Si to which the gate signals S[1] to S[i] are applied are disposed to be close to the output terminal of the data driver 300, and in the second sub-frame, the gate lines Si+1 to Sn to which the gate signals S[i+1] to S[n] are applied are disposed to be far from the output terminal of the data driver 300.

The first sub-frame corresponds to a period when the delay of the data voltage is superior to the output delay of the gate signal in one frame, and the second sub-frame corresponds to a period when the output delay of the gate signal is superior to the delay of the data signal in one frame. In an exemplary embodiment, the first sub-frame may correspond to a period when the gate signal S[i] of the intermediate gate line Si is output from the gate signal S[1] of the first gate line S1 as the gate-on voltage, and the second sub-frame may correspond to a period when the gate signal S[n] of the last gate line Sn is output from the gate signal S[i+1] of a subsequent gate line Si+1 of the intermediate gate line Si as the gate-on voltage. In an exemplary embodiment, the first sub-frame and the second sub-frame may have the same period that is, ½ frame.

However, the invention is not limited thereto, and the first sub-frame and the second sub-frame do not necessarily need to have the same time period. In the first sub-frame, the time period of the first sub-frame may be determined so that the OE margin between the gate signal and the data voltage may be adjusted to the optimal OE margin. In addition, in the second sub-frame, the time period of the second sub-frame may be determined so that the OE margin between the gate signal and the data voltage may be adjusted to the optimal OE margin. That is, the time period of the first sub-frame may be determined to be larger or smaller than the time period of the second sub-frame.

A method of delaying turn-on periods of the gate signals S[1] to S[i] and outputting the gate signals S[1] to S[i] in the first sub-frame and advancing turn-on periods of the gate signals S[i+1] to S[n] and outputting the gate signals S[i+1] to S[n] in the second sub-frame will be described in more detail.

A value ds divided by n, i.e., ds/n (hereinafter, referred to as a 'reference data delay value'), obtained by dividing the data delay value ds generated in the last gate line Sn by the total number n of gate lines is calculated.

In the first sub-frame, a time period for which the gate-on voltage of each of the gate signals S[1] to S[i] is applied is increased by a reference data delay value. Since the applying time of the gate-on voltage of the gate signal that is previously applied is increased by the reference data delay value, the gate-on voltage of a gate signal that is subsequently applied is delayed and applied by the reference data delay value. That is, in the first sub-frame, there is an effect that a timing when the gate signals S[1] to S[i] are applied as the gate-on voltages is delayed. In the first sub-frame, the i-th gate signal S[i] is delayed and output by a value {(ds/n)xi} obtained by multiplying the number i of gate signals outputting the gate-on voltages in the first frame by the reference data delay value.

In the second sub-frame, a time period for which the gate-on voltage of each of the gate signals S[i+1] to S[n] is applied is decreased by the reference data delay value. Since the applying time of the gate-on voltage of the gate signal that is previously applied is decreased by the reference data delay value, the gate-on voltage of the gate signal that is subsequently applied is advanced and applied by the reference data delay value. That is, in the second sub-frame, there is an effect that a timing when the gate signals S[i+1] to S[n] are applied as the gate-on voltages is advanced. In an exemplary embodiment, the time period for which the gate signals S[i+1] to S[n] are applied as the gate-on voltages in the second sub-frame may be smaller than the time period for which the gate signals S[1] to S[i] are applied in the first sub-frame by 2 ds/n.

Since the output of the gate signals S[1] to S[n] synchronizes with the clock signal applied to the gate driver 200, in order to delay the output of the gate signals S[1] to S[n], the clock signal is delayed and output, and in order to advance the output of the gate signals S[1] to S[n], the clock signal is advanced and applied, thereby adjusting an output timing of the gate signals S[1] to S[n].

As such, in the first sub-frame, the gate signals S[i+1] to S[i] are delayed and output, and as a result, the gate signal and the data voltage may be prevented from being asynchronous by the delay of the data voltage. In addition, in the second sub-frame, the gate signals S[i+1] to S[n] are advanced and output, and as a result, the gate signal and the data voltage may be prevented from being asynchronous by the output delay of the gate signal. Further, in one frame, the OE margin between the gate signals S[1] to S[n] and the data voltage may be approximated to the optimal OE margin.

Figure 6:
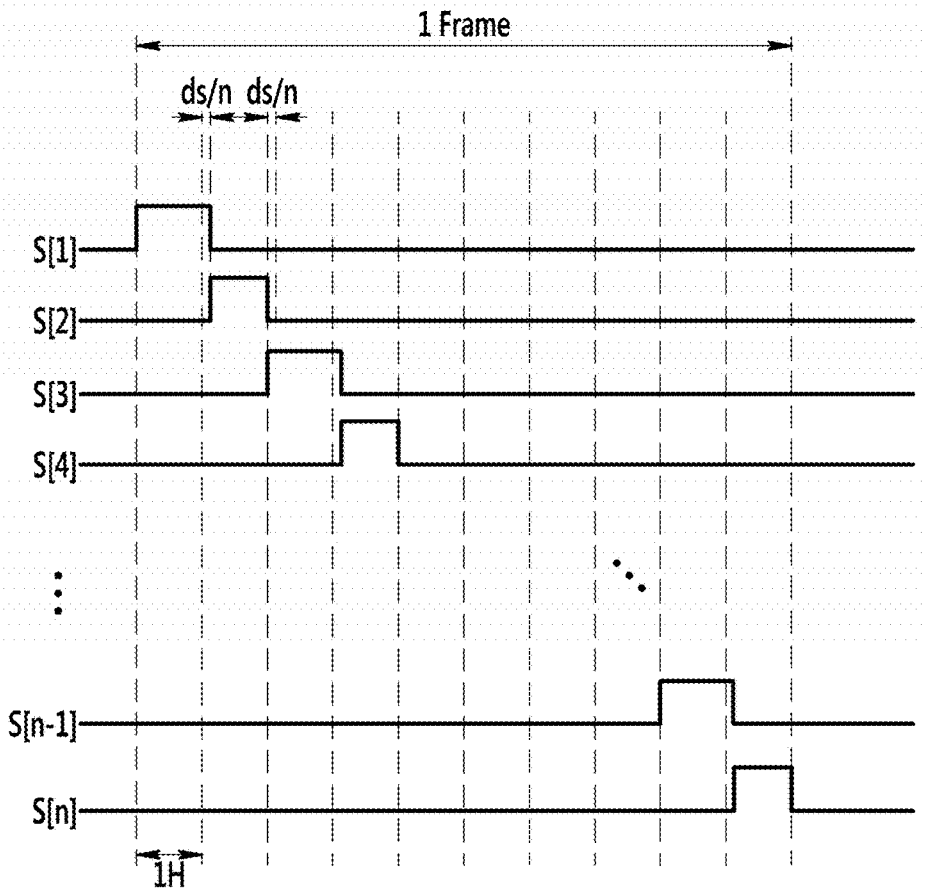
FIG. 6 is a timing diagram illustrating the exemplary embodiment of another method of applying a gate signal in the display device according to the invention.

FIG. 6 is a timing diagram illustrating another method of applying a gate signal in the display device according to the exemplary embodiment of the invention.

Referring to FIG. 6, in another exemplary embodiment of the invention, the gate driver 200 increases and decreases the time period for which the gate-on voltage is applied by the reference data delay value while alternating the gate signals S[1] to S[n] for each line. In an exemplary embodiment, the applying time of the gate-on voltages of the gate signals S[1], S[3], . . . , S[n−1] which are applied to odd gate lines S1, S3, . . . , Sn−1 may be increased by the reference data delay value, and the applying time of the gate-on voltages of the gate signals S[2], S[4], . . . , S[n] which are respectively applied to even gate lines S2, S4, . . . , Sn may be decreased by the reference data delay value.

Even in this case, in one frame, the OE margin between the gate signals S[1] to S[n] and the data voltage may be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device, comprising:

a display unit including:

a plurality of pixels, and a plurality of gate lines and a plurality of data lines which are connected to the plurality of pixels;

a data driver applying data voltages to the plurality of data lines; and a gate driver delaying turn-on periods of first gate signals and outputting the first gate signals applied to gate lines among the plurality of gate lines in a first sub-frame included in one frame and advancing turn-on periods of second gate signals and outputting the second gate signals which are applied to remaining gate lines among the plurality of gate lines in a second sub-frame, wherein a time period for which a gate-on voltage of the first gate signals is applied to gate lines among the plurality of gate lines in the first sub-frame is greater than a time period for which a gate-on voltage of the second gate signals is applied to remaining gate lines among the plurality of gate lines in the second sub-frame, in the first sub-frame, a time period of the first sub-frame is determined so as to adjust an output enable margin between the first gate signals and the plurality of data voltages to an optimal output enable margin, and the output enable margin is a time between a timing when the gate signal starts to be shifted from the gate-on voltage to the gate-off voltage and a timing when the data voltage at a high level starts to be shifted to a low level.

2. The display device of claim 1, wherein:

the gate lines to which the first gate signals are applied are disposed closer to an output terminal of the data driver and the remaining gate lines to which the second gate signals are applied are disposed farther from the output terminal of the data driver.

3. The display device of claim 1, wherein:

the first sub-frame is a period when a delay of the data voltage is superior to an output delay of the first gate signals in the one frame.

4. The display device of claim 3, wherein:

the second sub-frame is a period when the output delay of the second gate signals is superior to the delay of the data voltage in the one frame.

5. The display device of claim 1, wherein:

the gate driver increases a time period for which the gate-on voltage of each of the first gate signals is applied by a reference data delay value, and the reference data delay value is obtained by dividing a data delay value generated in a last gate line among the plurality of gate lines by a number of the plurality of gate lines.

6. The display device of claim 1, wherein:

the gate driver decreases a time period for which the gate-on voltage of each of the second gate signals is applied by the reference data delay value, and the reference data delay value is a value obtained by dividing a data delay value generated in a last gate line among the plurality of gate lines by a number of the plurality of gate lines.

7. The display device of claim 1, wherein:

in the second sub-frame, a time period of the second sub-frame is determined so as to adjust an output enable margin between the second gate signals and the plurality of data voltages to an optimal output enable margin.

8. The display device of claim 1, wherein:

the first sub-frame and the second sub-frame has the same time period of ½ frame.

9. A display device, comprising:

a display unit including:

a plurality of pixels, and a plurality of gate lines and a plurality of data lines which are connected to the plurality of pixels;

a data driver applying data voltages to the plurality of data lines; and a gate driver increasing and decreasing a time period for which a gate-on voltage is applied, and alternately applying gate signals to the plurality of gate lines, wherein the gate driver increases a time period for which gate-on voltages of the gate signals applied to odd gate lines among the plurality of gate lines are applied by a reference data delay value, and the reference data delay value is obtained by dividing a data delay value generated in a last gate line among the plurality of gate lines by a number of the plurality of gate lines.

10. The display device of claim 9, wherein:

the gate driver decreases a time period for which the gate-on voltages of the gate signals applied to even gate lines among the plurality of gate lines are applied by the reference data delay value.

11. A driving method of a display device including a plurality of pixels, and a plurality of gate lines and a plurality of data lines which are connected to the plurality of pixels, the method comprising:

calculating a reference data delay value by dividing a data delay value generated in a last gate line among the plurality of gate lines by a number of the plurality of gate lines;

delaying turn-on periods of first gate signals and outputting the first gate signals applied to gate lines among the plurality of gate lines in a first sub-frame included in one frame; and advancing turn-on periods of second gate signals and outputting the second gate signals which are applied to remaining gate lines among the plurality of gate lines in a second sub-frame included in the one frame, wherein the first gate signals are delayed and output by increasing a time period for which a gate-on voltage of each of the first gate signals is applied by the reference data delay value.

12. The driving method of claim 11, wherein:

the gate lines to which the first gate signals are applied are disposed to be closer to an output terminal of a data driver and the remaining gate lines to which the second gate signals are applied are disposed to be farther from the output terminal of the data driver.

13. The driving method of claim 11, wherein:

the second gate signals are advanced and output by decreasing a time period for which the gate-on voltage of each of the second gate signals is applied by the reference data delay value.

14. The driving method of claim 11, further comprising:

determining a time period of the first sub-frame so that an output enable margin which is a time between a timing when the first gate signal starts to be shifted from the gate-on voltage to the gate-off voltage and a timing when the data voltage at a high level starts to be shifted to a low level is adjusted to an optimal output enable margin.

15. The driving method of claim 11, further comprising:

determining a time period of the second sub-frame so that an output enable margin which is a time between a timing when the second gate signal starts to be shifted from the gate-on voltage to the gate-off voltage and a timing when the data voltage at a high level starts to be shifted to a low level is adjusted to an optimal output enable margin.

16. The driving method of claim 11, wherein:

the first sub-frame and the second sub-frame have the same time period of ½ frame.

17. The driving method of claim 11, wherein:

the first sub-frame is a period when a delay of the data voltage is superior to an output delay of the first gate signals in one frame, and the second sub-frame is a period when an output delay of the second gate signals is superior to the delay of the data voltage in the one frame.

* * * * *